US005511902A

United States Patent [19]

Center

[11] Patent Number: 5,511,902

[45] Date of Patent: Apr. 30, 1996

[54] INSTANT LEVY BLOCK SYSTEM

[76] Inventor: Leslie T. Center, P.O. Box FL284, Smith's Parish FL BX, Bermuda

[21] Appl. No.: 194,158

[22] Filed: Feb. 9, 1994

[51] Int. Cl.[6] ..... E02B 7/04

[52] U.S. Cl. ..... 405/16; 405/15; 405/21; 405/286

[58] Field of Search ..... 405/15, 21, 23, 405/25, 31, 33, 107, 114

[56] References Cited

U.S. PATENT DOCUMENTS

| | | | |
|---|---|---|---|
| 1,953,154 | 4/1934 | Cram | 405/284 |
| 3,969,900 | 7/1976 | Plodowski | 405/23 X |
| 4,330,224 | 5/1982 | Muramatsu et al. | 405/115 |
| 4,692,060 | 9/1987 | Jackson, III | 405/115 |
| 4,784,520 | 11/1988 | Stevens | 405/21 |
| 4,981,392 | 1/1991 | Taylor | 405/115 |
| 5,040,919 | 8/1991 | Hendrix | 405/415 |
| 5,114,270 | 5/1992 | Riddle | 405/15 |
| 5,161,918 | 11/1992 | Hodel | 405/286 |

*Primary Examiner*—Dennis L. Taylor
*Attorney, Agent, or Firm*—Richard L. Miller

[57] ABSTRACT

An instant block levy system, for constructing a levy, comprising a plurality of blocks, a plurality of connecting pegs, and a plurality of stakes. The block has a top surface and bottom surface, upper shaftways extending vertically into the top surface, and lower shaftways extending vertically into the bottom surface. The block has a ballasting chamber, and a fill hole in fluid communication with the ballasting chamber. The blocks may be stacked, such that a lower shaftway from a top block is concentric with a upper shaftway from a bottom block, so that the upper and lower shaftways can be connected with the connecting peg. The block has stake shaftways, extending through the block from the top surface to the bottom surface, so that the stake may be inserted therethrough, to anchor the block to the ground.

10 Claims, 1 Drawing Sheet

38
36
28
30
2
46
34
20
26
32
29
46
34
22
25
40
44
42
24
4
3
48
25

32
26
50
35
10
10
52
34
5
5
40
4

46
56
25
24
42

46
46
25
25
48
24

38
36
39

54

26
20
50
40

20
46
9

20
46

20T
52
54
32
20B

INSTANT LEVY BLOCK SYSTEM

BACKGROUND OF THE INVENTION

The invention relates to an instant levy block system. More particularly, the invention relates to a system of modular, reusable blocks, for creating a levy.

Severe flood conditions have occurred throughout the country in the recent era. Although flooding is expected by those living on coastal shorelines, flooding can also occur in unexpected locations. Flood damage can be as devastating as any other natural or man-made disaster.

Other attempts at preventing flood damage by creating a dam or levy involve apparatus that is complicated in manufacture and on-site assembly, is heavy and cumbersome, and does not provide adequate protection.

U.S. Pat. No. 4,330,224 to Muramatsu et al., discloses a collapsible rubber dam installations which is filled with a fluid upon on-site installation.

U.S. Pat. No. 4,692,060 to Jackson, discloses a water-bag dam or dike and method. A water-bag is filled with water, and assumes the shape of a triangular prism.

U.S. Pat. No. 4,981,392 to Taylor, discloses a water inflatable structural module that comprises two cylindrical water holding chambers joined along a horizontal mid-plane.

U.S. Pat. No. 5,040,919 to Hendrix, discloses a device for controlling flood waters and/or hazardous liquid spills.

While these units may be suitable for the particular purpose employed, or to general use, they would not be as suitable for the purposes of the present invention as hereafter described.

SUMMARY OF THE INVENTION

It is an object of the invention to produce a levy block system that can effectively protect property from rising flood waters.

It is another object of the invention to produce a levy block system that can be quickly and easily deployed into use, and then disassembled for reuse.

It is a further object of the invention to produce a levy block system that is inexpensive to manufacture.

It is a still further object of the invention to produce a levy block system that provides a large degree of structural strength and stability per unit.

The invention is an instant block levy system, for constructing a levy, comprising a plurality of blocks, a plurality of connecting pegs, and a plurality of stakes. The block has a top surface and bottom surface, upper shaftways extending vertically into the top surface, and lower shaftways extending vertically into the bottom surface. The block has a ballasting chamber, and a fill hole in fluid communication with the ballasting chamber. The blocks are stacked, such that a lower shaftway from a top block is concentric with a upper shaftway from a bottom block, so that the upper and lower shaftways can be connected with the connecting peg. The block has stake shaftways, extending through the block from the top surface to the bottom surface, so that the stake may be inserted therethrough, to anchor the block to the ground.

To the accomplishment of the above and related objects, the invention may be embodied in the form illustrated in the accompanying drawings. Attention is called to the fact that variations are contemplated as being part of the present invention, limited only by the scope of the claims.

BRIEF DESCRIPTION OF THE DRAWINGS

In the drawings, like elements are depicted by like reference numerals throughout the several views. The drawings are briefly described below.

DETAILED DESCRIPTION OF THE PREFERRED EMBODIMENT

Figure 1:
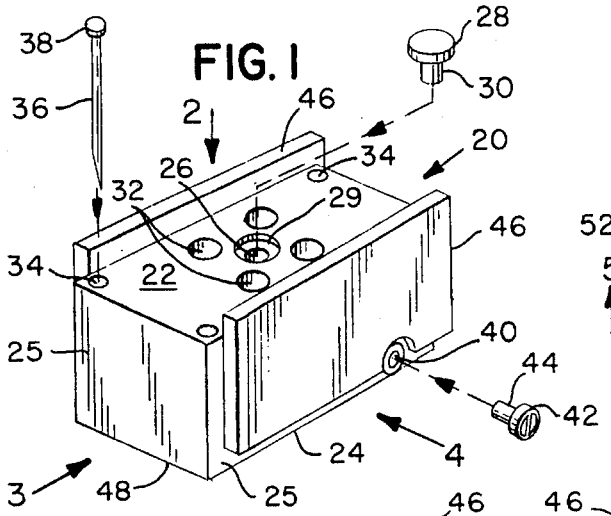
FIG. 1 is a diagrammatic perspective view of a typical single block of the instant invention.

FIG. 1 illustrates a block 20, which is the basic unit of the levy system of the present invention, by which a plurality of blocks 20 are combined to form a levy. The block 20 is in the form of a rectangular prism, and has a top surface 22, a bottom surface 24, and four sides 25.

The top surface 22 has a fill hole 26, for receiving a fill plug 28, having a threaded fill shaft 30. The fill hole 26 has a file hole counterbore 29, so that the fill plug 28, when fully inserted into the fill hole 26, can rest below the top surface 22. Upper shaftways 32 extend vertically into the block 20 from the top surface 22. The upper shaftways 32 have substantially the same diameter, and extend substantially the same distance into the block 20.

Figure 6:
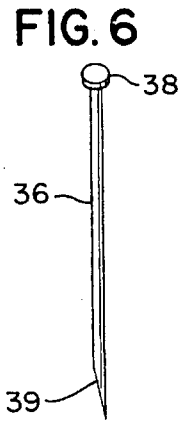
FIG. 6 is an diagrammatic perspective view of a typical stake.

Stake shaftways 34 extend vertically through the block 20 from the top surface 22 to the bottom surface 24. A stake 36, approximately the same diameter as the stake shaftway 34 can be used to anchor the block to the ground. The stake 36 may have an enlarged optional stake head 38. The stake 36 is further illustrated in FIG. 6. The stake has a sharp end 39, opposite the stake head 38.

A drain hole 40 is present in the block near the bottom surface 24, on one of the sides 25. The drain hole 40 receives a drain hole plug 42, having a threaded drain shaft 44. The threaded drain shaft 44 creates a tight seal, even under undue pressure against the drain hole plug 42.

A pair of end plates 46 are mounted onto two opposite sides 25. The opposite sides are connected by a connecting edge 48. The end plates are each substantially the same size as the side 25 to which they are mounted, are mounted parallel to each other, and are each offset an equal distance from the connecting edge 48.

Figure 2:
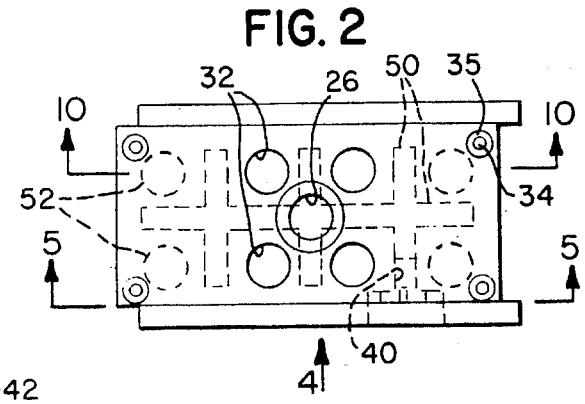
FIG. 2 is a top elevational view, taken in the direction of arrow 2 in FIG. 1.

FIG. 2 is a top plan view, illustrating the block 20. Ballasting chambers 50, illustrated with hidden lines, are in fluid communication with the fill hole 26, and the drain hole 40. The ballasting chambers 50 are used for holding water within the block 20, to increase its weight, and thus, the overall stability of the levy constructed with the blocks.

Lower shaftways 52 extend vertically into the block from the bottom surface. The lower shaftways 52 do not extend fully through the block 20, and thus appear as hidden lines in FIG. 2. The lower shaftways 52, each extend substantially the same distance up into the block 20. The lower shaftways 52 are of a diameter that is substantially the same as the diameter of the upper shaftways 32.

Each stake shaftway 34 has a stake shaftway counterbore 35, for accepting the stake head 38. The stake shaftway counterbore 35 allows the stake head 38 to rest below the top surface 22.

Figure 10:
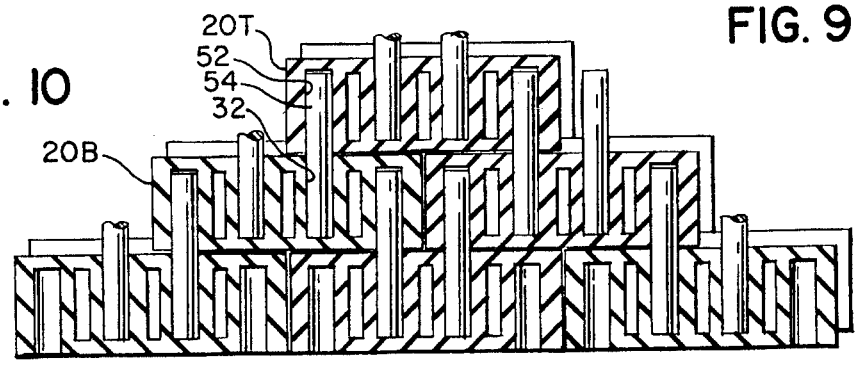
FIG. 10 is a diagrammatic cross sectional view, with parts broken away, taken on line 10—10 of FIG. 2, illustrating how the pegs are used to connect identical blocks so as to form a levy.

Referring to FIG. 10, the relative positioning of the upper shaftways 32 and lower shaftways 52 is such that two blocks can be stacked on top of each other, with a top block 20T staggered halfway across a bottom block 20B. When the blocks are thus arranged, at least one upper shaftway on the bottom block will be concentric with a lower shaftway of the top block. The blocks can then be connected with a connecting peg 54.

Figure 7:
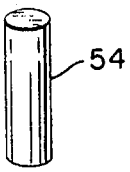
FIG. 7 is a diagrammatic perspective view of a typical connecting peg.

Referring to FIG. 7, the connecting peg 54 is substantially cylindrical. The diameter of the connecting peg 54 is substantially the same as the diameter of the upper shaftway 32 and lower shaftway 52.

Referring to FIG. 10, the length of the connecting peg 54 is substantially the same as the sum of the distance that the upper shaftway 32 extends into the bottom block 20B and the distance that the lower shaftway 52 extends into the top block 20T.

Figure 4:
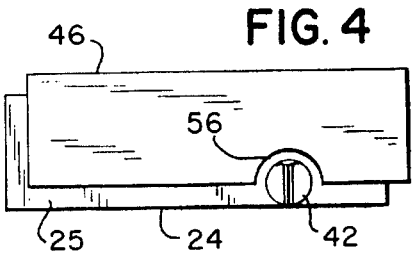
FIG. 4 is a side elevational view, taken in the direction of arrow 4 in FIG. 1.
Figure 3:
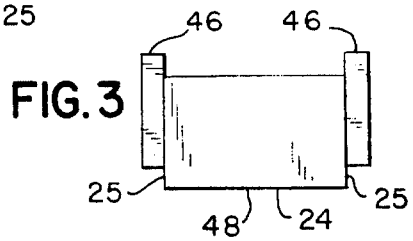
FIG. 3 is an end elevational view, taken in the direction of arrow 3 in FIG. 1.

FIG. 3 and FIG. 4 illustrate the relative positioning of the end plates 46. Referring to FIG. 3, the end plates are attached to a pair of opposite sides 25, at a fixed distance from the connecting edge 48. Also illustrated is that the end plates 46 are essentially parallel to each other.

FIG. 4 details an optional drain plug cut-out 56, in the end plate 46 of the side 25 bearing the drain plug 42.

Figure 5:
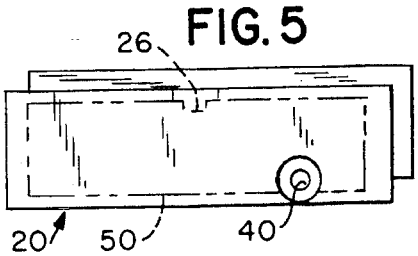
FIG. 5 is a diagrammatic sectional view, taken on line 5—5 of FIG. 2, showing some internal construction features in dotted lines.

FIG. 5 illustrates the block 20, with an end plate removed, according to line 5—5 in FIG. 2. The ballasting chamber 50 is shown with hidden lines, as is the fill hole 26. The drain hole 40, the ballasting chamber 50, and the fill hole 26 are all in fluid communication.

Figure 8:
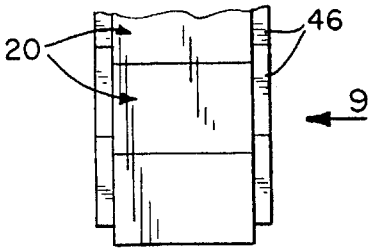
FIG. 8 is a diagrammatic end elevational view, with parts broken away, showing three blocks vertically stacked upon one another.
Figure 9:
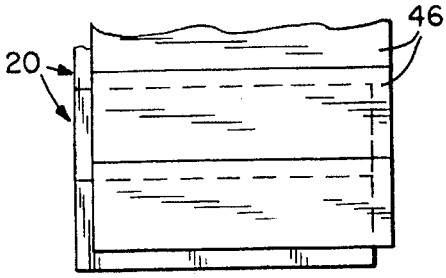
FIG. 9 is an elevational view, taken in the direction of arrow 9 in FIG. 8 showing blocks in a stored position.

FIG. 8 and 9 illustrate that when the blocks 20 are stacked, adjacent end plates 46 come into close proximity, creating a seal therebetween.

The blocks 20 may be formed of plastic, or firm rubber. The end plates 46 should preferably be made of rubber, to create a tight seal between the end plates of adjacent blocks. The connecting pegs may be fabricated out of plastic, rubber or steel. The stakes should be made of steel.

What is claimed is:

1. An instant levy block system, for creating a levy, comprising:

a) a block, the block being in the general shape of a rectangular prism, the block having a top surface and a bottom surface, the top surface having at least one upper shaftway extending a distance vertically into the block, the bottom surface having at least one lower shaftway extending a distance vertically into the block; and b) a connecting peg, the connecting peg of a length substantially the same as the sum of the distance that the upper shaftway extends into the block and the distance that the lower shaftway extends into the block, the connecting peg sized to fit in the upper shaftway and lower shaftway of the block, for connecting said block to another identical block, the block further comprising:

i) a pair of opposite sides joined by a pair of opposite connecting ends extending between top and bottom surfaces; and ii) a pair of end plates, each end plate being of substantially the same size as the pair of opposite sides and mounted to each of the pair of opposite sides in parallel relation and at equal distances from one of the connecting ends and from the bottom surface so as to protrude from the other of the connecting ends and from the top surface; the upper shaftway and lower shaftway being positioned so that a pair of identical blocks, comprising a top block and a bottom block, can be stacked with the top block overlying half of the bottom block, and with the upper shaftway of the bottom block substantially concentric with the lower shaftway of the upper block so that both shaftways can receive the connecting peg and with the end plates of the bottom block in intimate sealing engagement with portions of the opposite sides of the upper block which are below respective end plates thereof.

2. The apparatus as recited in claim 1, wherein:

a) the block further comprises a stake, shaftway, extending through the block from the top surface to the bottom surface; and b) the apparatus further comprises a stake, having a diameter that is substantially the same as the stake shaftway, for securing the block to the ground.

3. The apparatus as recited in claim 1, wherein the end plates are made of a flexible, rubber-like material.

4. The apparatus as recited in claim 3, wherein the block is made of one of plastic or firm rubber.

5. The apparatus as recited in claim 1, wherein the block further comprises:

a) a ballasting chamber, for filling with a liquid to add weight to the block; and b) a fill hole, near the top surface, the fill hole in fluid communication with the ballasting chamber.

6. The apparatus as recited in claim 5, wherein the block further comprises a drain hole mounted near the bottom surface, the drain hole in fluid communication with the ballasting chamber.

7. The apparatus as recited in claim 6, further comprising a drain plug, having a threaded drain shaft, for creating a tight seal in the drain hole.

8. The apparatus as recited in claim 7, wherein:

a) the block further comprises a stake shaftway, extending through the block from the top surface to the bottom surface; and b) the apparatus further comprise a stake, having a diameter that is substantially the same as the stake shaftway, for securing the block to the ground.

9. The apparatus as recited in claim 7, wherein the end plates are made of a flexible, rubber-like material.

10. The apparatus as recited in claim 9, wherein the block is made of one of plastic or firm rubber.

* * * * *